US007475497B2

(12) United States Patent
Hoffer et al.

(10) Patent No.: US 7,475,497 B2
(45) Date of Patent: Jan. 13, 2009

(54) ARTICLE OF FOOTWEAR WITH A PERFORATED MIDSOLE

(75) Inventors: Kevin W. Hoffer, Portland, OR (US); John Hurd, Tigard, OR (US)

(73) Assignee: Nike, Inc., Beaverton, OR (US)

( * ) Notice: Subject to any disclaimer, the term of this patent is extended or adjusted under 35 U.S.C. 154(b) by 538 days.

(21) Appl. No.: 11/036,617

(22) Filed: Jan. 18, 2005

(65) Prior Publication Data

US 2006/0156579 A1 Jul. 20, 2006

(51) Int. Cl.
*A43B 13/18* (2006.01)

(52) U.S. Cl. ..... 36/28; 36/3 R; 36/44

(58) Field of Classification Search ..... 36/28, 36/29, 30 R, 44, 3 R, 3 B
See application file for complete search history.

(56) References Cited

U.S. PATENT DOCUMENTS

| | | | | | |
|---|---|---|---|---|---|
| 1,390,929 | A | | 9/1921 | Saudino | |
| 1,932,557 | A | | 10/1933 | Meucci | |
| 2,098,412 | A | | 11/1937 | Bovay | |
| 2,713,215 | A | * | 7/1955 | Cosneck | 36/44 |
| 3,253,355 | A | * | 5/1966 | Menken | 36/29 |
| 3,256,621 | A | | 6/1966 | Linten | |
| 4,336,661 | A | * | 6/1982 | Medrano | 36/44 |
| 4,378,641 | A | | 4/1983 | Tarlow | |
| 4,438,573 | A | | 3/1984 | McBarron | |
| 4,445,284 | A | | 5/1984 | Sakutori | |
| 4,571,853 | A | * | 2/1986 | Medrano | 36/43 |
| 4,617,745 | A | | 10/1986 | Batra | |
| 4,813,160 | A | | 3/1989 | Kuznetz | |
| 4,878,300 | A | * | 11/1989 | Bogaty | 36/35 R |
| 4,885,849 | A | * | 12/1989 | Lambert | 36/3 B |
| 4,910,887 | A | | 3/1990 | Turner et al. | |
| 4,912,858 | A | | 4/1990 | Mochizuki | |
| 4,939,851 | A | | 7/1990 | Miller | |
| 5,042,175 | A | * | 8/1991 | Ronen et al. | 36/28 |
| 5,261,169 | A | * | 11/1993 | Williford | 36/43 |
| 5,282,288 | A | * | 2/1994 | Henson | 12/142 P |
| 6,305,100 | B1 | | 10/2001 | Komarnycky et al. | |
| 7,131,218 | B2 | * | 11/2006 | Schindler | 36/29 |
| 2005/0097777 | A1 | * | 5/2005 | Goodwin | 36/29 |
| 2005/0183287 | A1 | * | 8/2005 | Schindler | 36/29 |

* cited by examiner

*Primary Examiner*—Marie Patterson
(74) *Attorney, Agent, or Firm*—Banner & Witcoff, Ltd.

(57) ABSTRACT

An article of footwear is disclosed that includes an upper and a sole structure secured to the upper. The sole structure includes a midsole element, an upper sheet, and a lower sheet. The midsole element has an upper surface and an opposite lower surface. In addition, the midsole element defines a plurality of bores extending from the upper surface to the lower surface. The upper sheet is secured to the upper surface and extends over at least a portion of the bores. The lower sheet is secured to the lower surface, and the lower sheet is positioned to correspond in location with the upper sheet and extend under the portion of the bores.

23 Claims, 16 Drawing Sheets

ARTICLE OF FOOTWEAR WITH A PERFORATED MIDSOLE

BACKGROUND OF THE INVENTION

1. Field of the Invention

The present invention relates to footwear. The invention concerns, more particularly, an article of footwear with a plurality of perforations extending in a substantially vertical direction through a midsole.

2. Description of Background Art

A conventional article of athletic footwear includes two primary elements, an upper and a sole structure. The upper provides a covering for the foot that securely receives and positions the foot with respect to the sole structure. In addition, the upper may have a configuration that protects the foot and provides ventilation, thereby cooling the foot and removing perspiration. The sole structure is secured to a lower surface of the upper and is generally positioned between the foot and the ground. In addition to attenuating ground reaction forces, the sole structure may provide traction and control foot motions, such as pronation. Accordingly, the upper and the sole structure operate cooperatively to provide a comfortable structure that is suited for a variety of ambulatory activities, such as walking and running.

The sole structure of athletic footwear generally exhibits a layered configuration that includes a comfort-enhancing insole, a resilient midsole formed from a polymer foam material, and a ground-contacting outsole that provides both abrasion-resistance and traction. The midsole is the primary sole structure element that attenuates ground reaction forces and controls foot motions. Suitable polymer foam materials for the midsole include ethylvinylacetate or polyurethane that compress resiliently under an applied load to attenuate ground reaction forces. Conventional polymer foam materials are resiliently compressible, in part, due to the inclusion of a plurality of open or closed cells that define an inner volume substantially displaced by gas. The polymer foam materials of the midsole may also absorb energy when compressed during ambulatory activities.

The midsole may be formed from a unitary element of polymer foam that extends throughout the length and width of the footwear. With the exception of a thickness differential between the heel and forefoot areas of the footwear, such a midsole exhibits substantially uniform properties in each area of the sole structure. In order to vary the properties of midsole, some conventional midsoles incorporate dual-density polymer foams. More particularly, a lateral side of the midsole may be formed from a first foam material, and the medial side of the midsole may be formed from a second, less-compressible foam material. Another manner of varying the properties of the midsole involves the use of stability devices that resist pronation. Examples of stability devices include U.S. Pat. No. 4,255,877 to Bowerman; U.S. Pat. No. 4,288,929 to Norton et al.; U.S. Pat. No. 4,354,318 to Frederick et al.; U.S. Pat. No. 4,364,188 to Turner et al.; U.S. Pat. No. 4,364,189 to Bates; and U.S. Pat. No. 5,247,742 to Kilgore et al.

Another manner of varying the properties of the midsole involves the use of fluid-filled bladders. U.S. Pat. No. 4,183,156 to Rudy, discloses an inflatable insert formed of elastomeric materials. The insert includes a plurality of tubular chambers that extend substantially longitudinally throughout the length of the footwear. The chambers are in fluid communication with each other and jointly extend across the width of the footwear. U.S. Pat. No. 4,219,945 to Rudy discloses an inflated insert encapsulated in a polymer foam material. The combination of the insert and the encapsulating polymer foam material functions as the midsole. Examples of additional fluid-filled bladders for footwear include U.S. Pat. Nos. 4,906,502 and 5,083,361, both to Rudy, and U.S. Pat. Nos. 5,993,585 and 6,119,371, both to Goodwin et al.

SUMMARY OF THE INVENTION

The present invention is an article of footwear having an upper and a sole structure secured to the upper. The sole structure includes a midsole element, a first sheet, and a second sheet. The midsole element is formed from a polymer foam material and has a first surface and an opposite second surface. The midsole element extends through a portion of a longitudinal length of the sole structure and from a lateral side to a medial side of the sole structure. In addition, the midsole element defines a plurality of bores extending through the polymer foam material and from the first surface to the second surface. The first sheet is secured to the first surface and extends over at least a portion of the bores. The second sheet is secured to the second surface, and the second sheet is positioned to correspond in location with the first sheet and extend under the portion of the bores.

The bores may extend in a substantially vertical direction and exhibit a hexagonal shape, or the bores may be triangular, square, pentagonal, or round, for example. The bores may also form a tessellation or have an tapered structure. In some embodiments, the dimensions of the bores vary throughout the midsole element, and one of the bores with relatively large dimensions may be positioned in a heel region of the footwear and in a location that corresponds with a calcaneus bone of a foot. The first sheet and the second sheet cover some of the bores and seal a fluid within the bores. A portion of the bores may also be exposed.

The first sheet and the second sheet may be positioned in a heel region of the footwear, in a forefoot region of the footwear, or adjacent one of the lateral and medial sides. In some embodiments, the first sheet forms three discrete portions that are respectively positioned in the heel region, at least one of the forefoot region and the midfoot region, and the forefoot region. The second sheet may also form three discrete portions positioned to correspond in location with the three discrete portions of the first sheet. The first sheet and the second sheet may be formed from a polymer material, and the first sheet and the second sheet may be bonded to the midsole element. In addition, the second sheet may be an outsole.

The advantages and features of novelty characterizing the present invention are pointed out with particularity in the appended claims. To gain an improved understanding of the advantages and features of novelty, however, reference may be made to the following descriptive matter and accompanying drawings that describe and illustrate various embodiments and concepts related to the invention.

DESCRIPTION OF THE DRAWINGS

The foregoing Summary of the Invention, as well as the following Detailed Description of the Invention, will be better understood when read in conjunction with the accompanying drawings.

DETAILED DESCRIPTION OF THE INVENTION

The following discussion and accompanying figures disclose an article of footwear having a sole element in accordance with the present invention. Concepts related to sole element are disclosed with reference to footwear having a configuration that is suitable for various athletic activities, including running, for example. The invention is not solely limited to articles of footwear designed for running, however, and may be applied to a wide range of athletic footwear styles that include basketball shoes, training shoes, walking shoes, hiking shoes and boots, tennis shoes, volleyball shoes, soccer shoes, and football shoes, for example. In addition to athletic footwear, concepts related to the invention may be applied to footwear that is generally considered to be non-athletic (e.g., dress shoes, sandals, and work boots) or footwear serving a medical or rehabilitative purpose. Accordingly, one skilled in the relevant art will appreciate that the concepts disclosed herein apply to a wide variety of footwear styles, in addition to the specific footwear style discussed in the following material and depicted in the accompanying figures.

Figure 1:
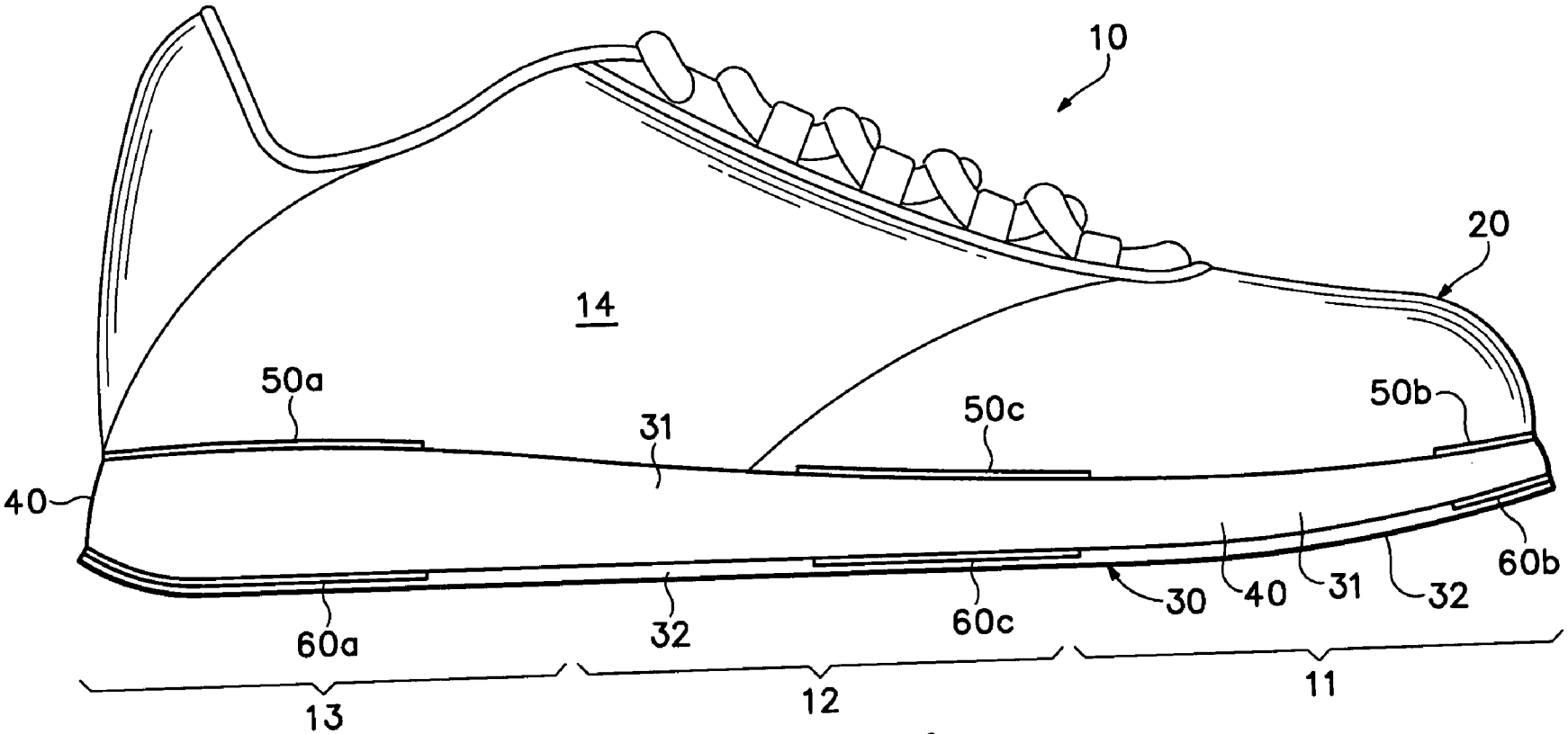
FIG. 1 is a lateral side elevational view of an article of footwear having a midsole in accordance with the present invention.

An article of footwear 10, as depicted in FIG. 1, includes an upper 20 and a sole structure 30 that are suitable for a variety of athletic activities, including running, for example. Upper 20 has a generally conventional configuration incorporating a plurality of material elements (e.g., textiles, foam, and leather) that are stitched or adhesively bonded together to form an interior void for securely and comfortably receiving a foot. The material elements may be selected and located with respect to upper 20 in order to selectively impart properties of durability, air-permeability, wear-resistance, flexibility, and comfort, for example. In addition, upper 20 may include a lace that is utilized in a conventional manner to modify the dimensions of the interior void, thereby securing the foot within the interior void and facilitating entry and removal of the foot from the interior void. The lace may extend through apertures in upper 20, and a tongue portion of upper 20 may extend between the interior void and the lace. Accordingly, upper 20 may exhibit a substantially conventional configuration within the scope of the present invention.

For reference purposes in the following material, footwear 10 may be divided into three general regions: a forefoot region 11, a midfoot region 12, and a heel region 13, as defined in FIG. 1. Forefoot region 11 generally includes portions of footwear 10 corresponding with the toes and the joints connecting the metatarsals with the phalanges. Midfoot region 12 generally includes portions of footwear 10 corresponding with the arch area of the foot, and heel region 13 corresponds with rear portions of the foot, including the calcaneus bone. Footwear 10 also includes a lateral side 14 and a medial side 15. Regions 11-13 and sides 14-15 are not intended to demarcate precise areas of footwear 10. Rather, regions 11-13 and sides 14-15 are intended to represent general areas of footwear 10 to aid in the following discussion. In addition to footwear 10 generally, references to the various regions 11-13 and sides 14-15 may also be applied to upper 20, sole structure 30, and individual elements thereof.

Sole structure 30 is secured to a lower area of upper 20 and is generally positioned between upper 20 and the ground, thereby extending between the foot and the ground. The primary elements of sole structure 30 are a midsole 31 and an outsole 32. Midsole 31 is secured to a lower area of upper 20 and attenuates ground reaction forces as sole structure 30 is compressed between the foot and the ground. Midsole 31 may also absorb energy when compressed. Outsole 32 is secured to a lower surface of midsole 31 and is formed from a durable and abrasion-resistant material, such as rubber, that may be textured to define various protrusion for providing traction. Although outsole 32 is depicted as a unitary element extending through each of regions 11-13, outsole 32 may be two or more separate elements, for example. In addition, sole structure 30 may incorporate an insole (not depicted) that is positioned within the interior void in upper 20 and located to correspond with a plantar (i.e., lower) surface of the foot, thereby enhancing the comfort of footwear 10.

Midsole 31 is depicted individually in FIGS. 2-5 and includes a midsole element 40, three upper sheets 50*a*-50*c*, and three lower sheets 60*a*-60*c*. Midsole element 40 includes an upper surface 41, an opposite lower surface 42, and a plurality of bores 43 extending through midsole 31 in a substantially vertical direction and between upper surface 41 and lower surface 42. In general, midsole element 40 is formed from a polymer foam material, such as polyurethane or ethylvinylacetate, that extends along at least a portion of the longitudinal length of footwear 10 (i.e., through regions 11-13) and also from at least a portion of lateral side 14 to medial side 15. In some embodiments, midsole element 40 may be formed from two or more discrete material elements (i.e., a forefoot element and a heel element), or midsole element 40 may be formed from a dual-density foam (i.e., lateral side 14 may be formed from a softer foam than medial side 15). In addition, midsole element 40 may taper downward between heel region 13 and forefoot region 11. Upper sheets 50*a*-50*c* are secured to upper surface 41, and lower sheets 60*a*-60*c* are secured to corresponding locations on lower surface 42. Accordingly, upper sheets 50*a*-50*c* and lower sheets 60*a*-60*c* respectively extend over and under various bores 43 to seal a fluid within the various bores 43. Some of bores 43, however, are exposed (i.e., not covered on opposite sides by two of sheets 50*a*-50*c* and 60*a*-60*c*).

Figure 4B:
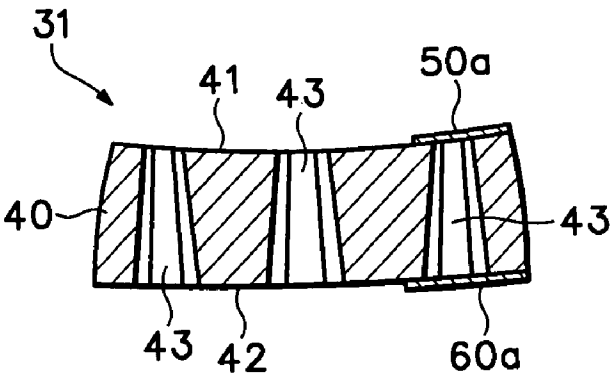
FIG. 4B is a second cross-sectional view of the midsole, as defined by section line 4B-4B in FIG. 2.
Figure 4A:
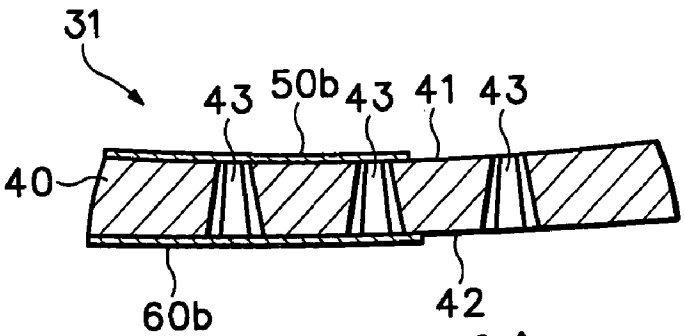
FIG. 4A is a first cross-sectional view of the midsole, as defined by section line 4A-4A in FIG. 2.

Midsole element 40 may be manufactured through a molding process, wherein a polymer material is injected into a mold having the shape of midsole element 40. The various bores 43 may be formed, therefore, by projections that extend between upper and lower portions of the mold. The configuration of bores 43 may vary significantly within the scope of the present invention. For example, bores 43 may exhibit constant dimensions between upper surface 41 and lower surface 42. Referring to FIGS. 4A and 4B, however, bores 43 are depicted as having a tapered configuration. More particularly, the dimensions of bores 43 adjacent to upper surface 41 are less then the dimensions of bores 43 adjacent to lower surface 42. That is, bores 43 may taper inward between lower surface 42 and upper surface 41. In other embodiments, bores 43 may taper outward between lower surface 42 and upper surface 41. In addition, various other elements may be incorporated into midsole element 40 during the manufacturing process, such as stability devices or fluid-filled bladders, as discussed in the Background of the Invention section.

Figure 2:
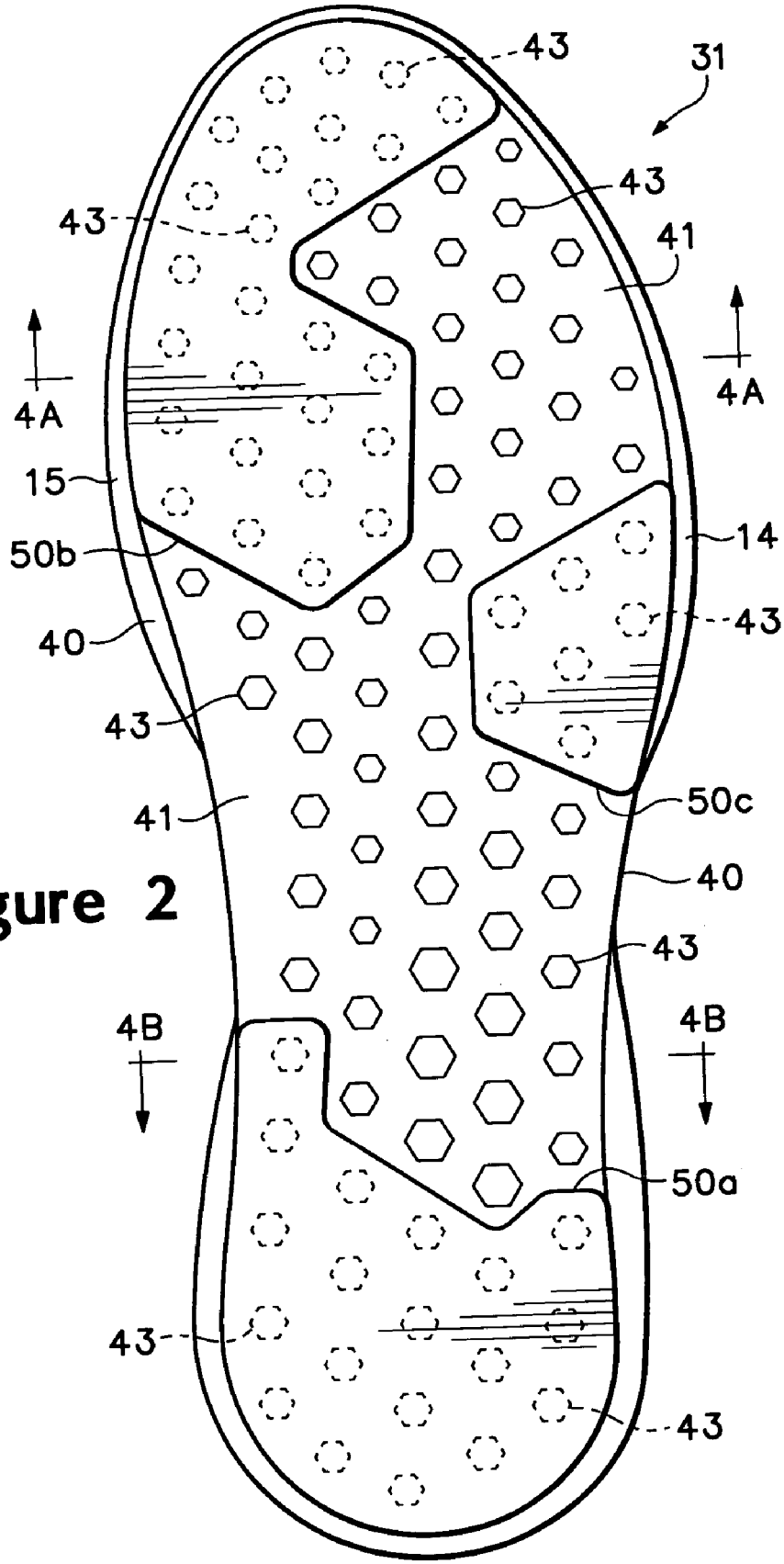
FIG. 2 is a top plan view of the midsole.
Figure 3:
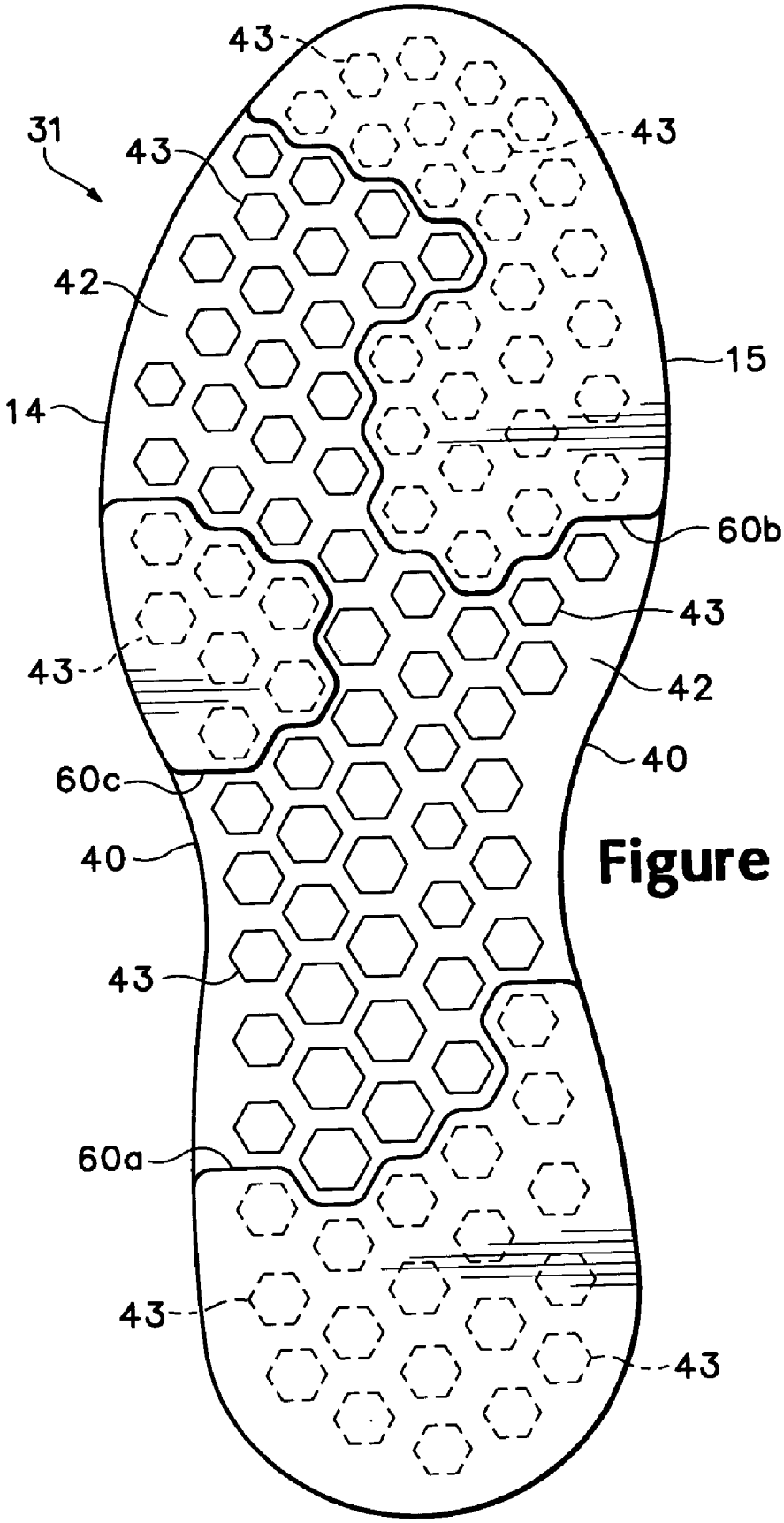
FIG. 3 is a bottom plan view of the midsole.
Figure 5:
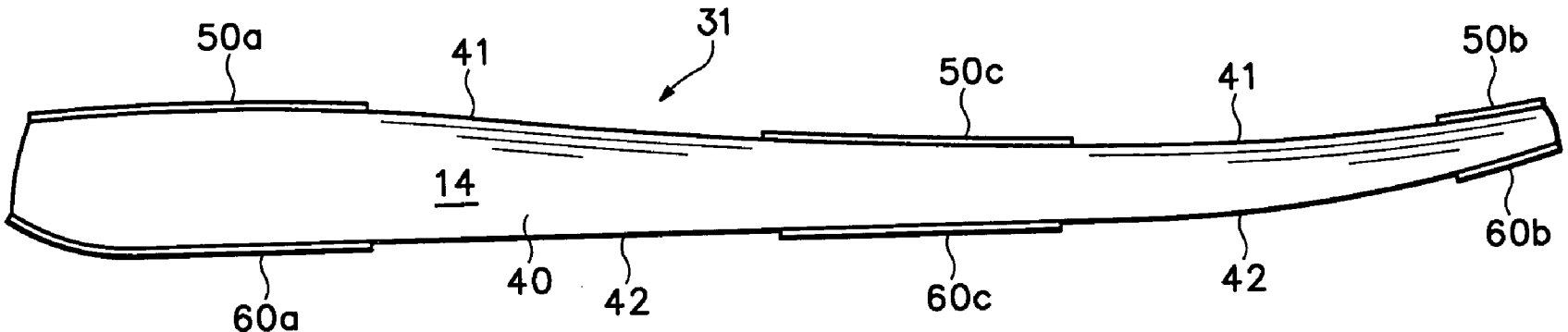
FIG. 5 is a lateral side elevational view of the midsole.
Figure 6A:
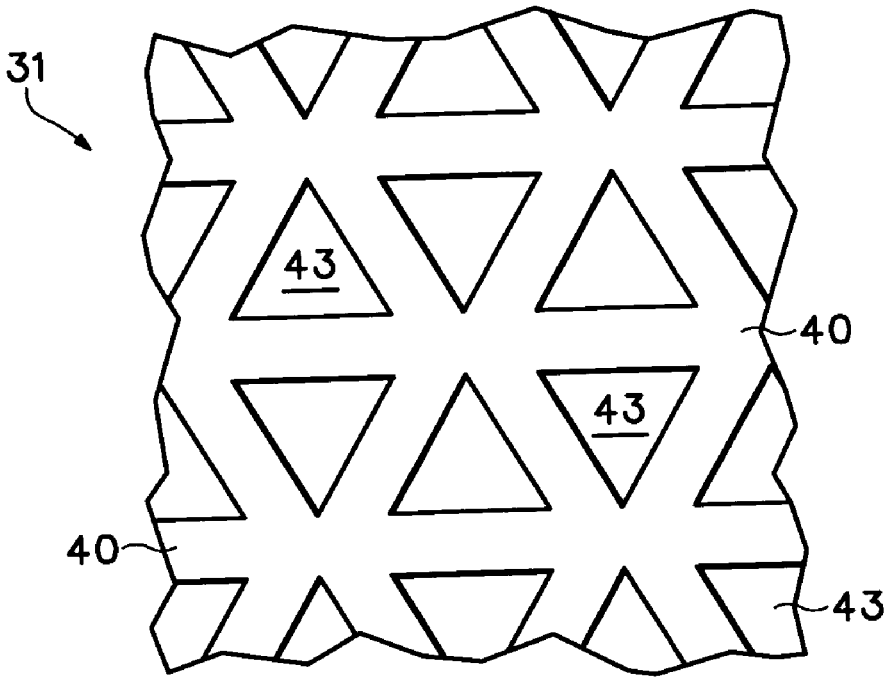
FIGS. 6A-6G are top plan views of portions of alternate midsole configurations.
Figure 6B:
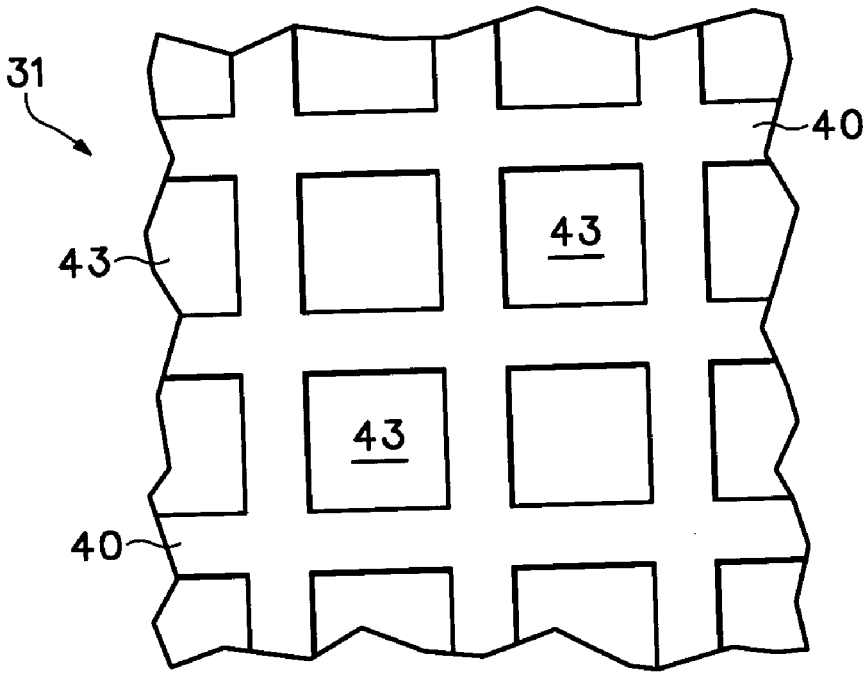

The shapes of bores 43 may also vary significantly within the scope of the present invention to include the hexagonal shape depicted in FIGS. 2, 3, and 5, for example. Bores 43 may also exhibit triangular or square shapes, as depicted in FIGS. 6A and 6B. An advantage of the hexagonal, triangular, and square shapes relates to the manner in which the various bores 43 may be arranged in upper surface 41 or lower surface 42 of midsole element 40. More particularly, bores 43 having hexagonal, triangular, or square shapes may be arranged to effectively form a tessellation in upper surface 41 or lower surface 42. As utilized herein, the term "tessellation" is defined as a covering of an area, without significant gaps or overlaps, by congruent plane figures of one type or a plurality of types. Accordingly, bores 43 having hexagonal, triangular, or square shapes, as viewed in either upper surface 41 or lower surface 42, may be arranged such that edges of the various bores 43 are adjacent to edges of other bores 43 and few significant gaps are formed between the bores 43.

Figure 6C:
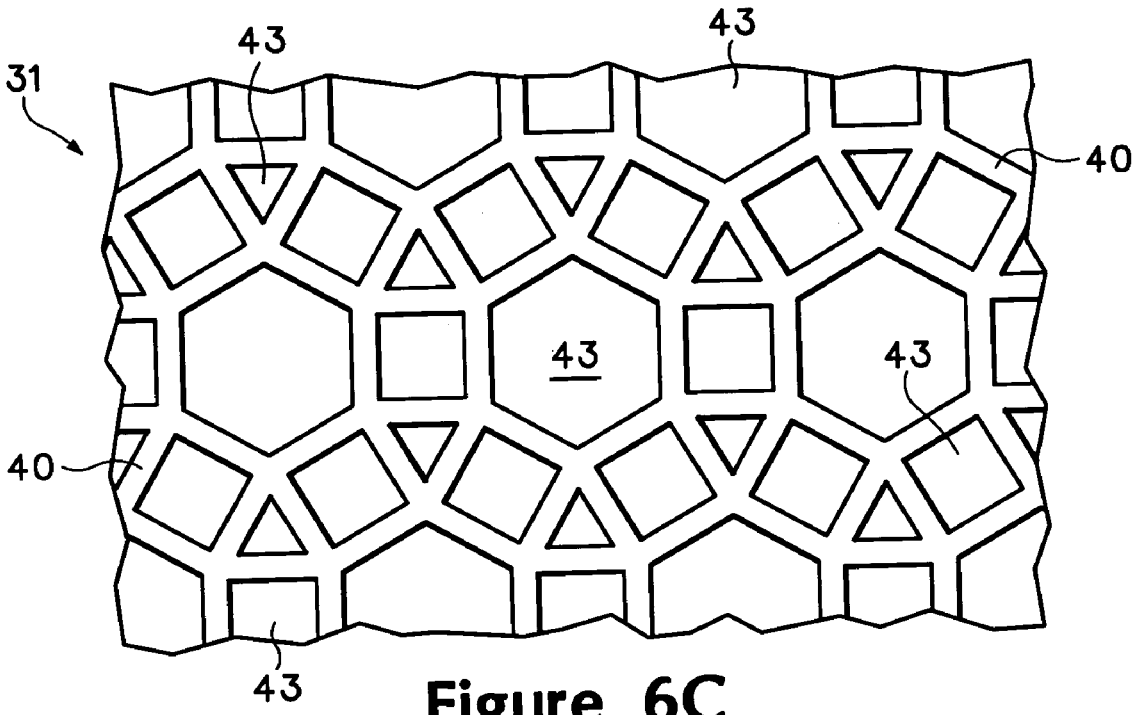
Figure 6D:
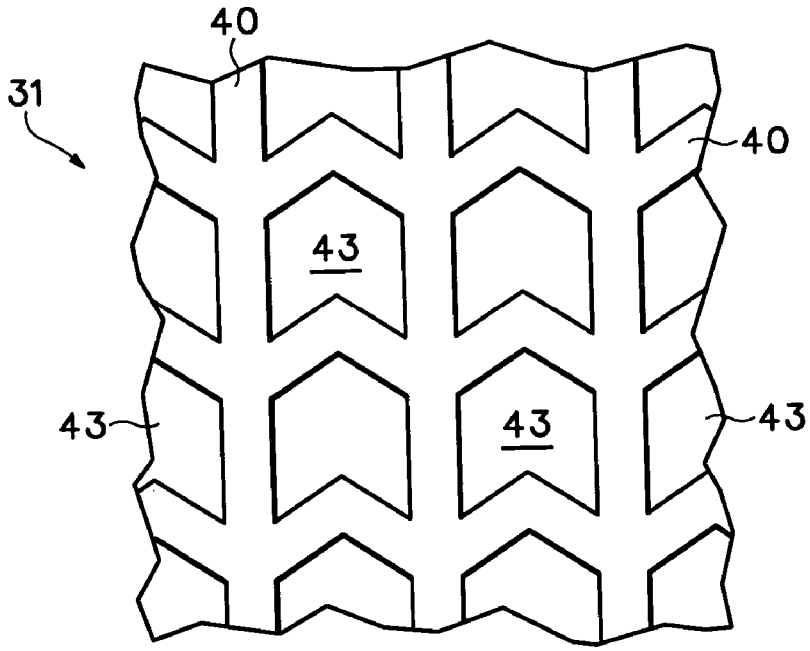
Figure 6E:
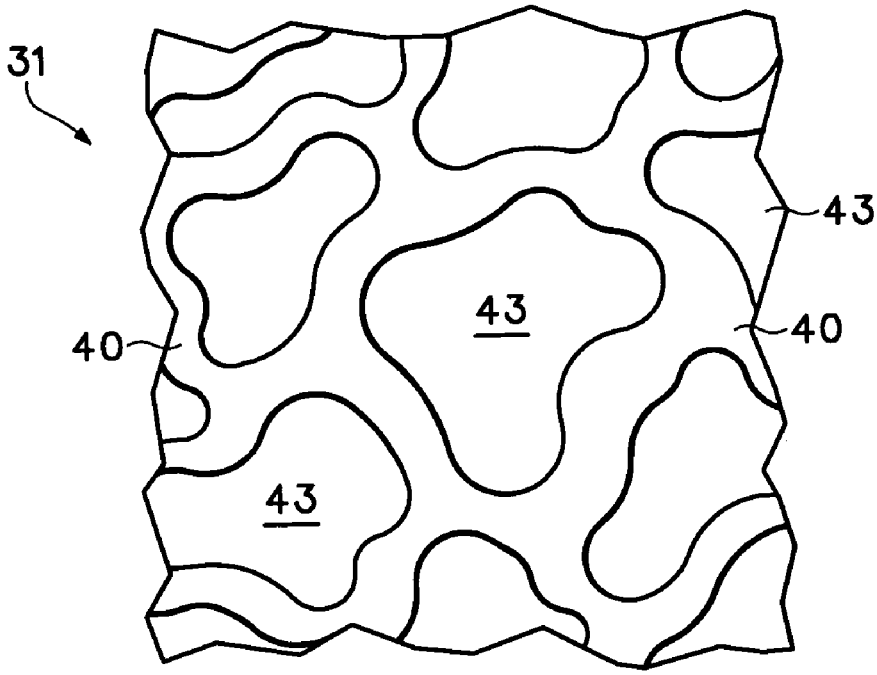
Figure 6F:
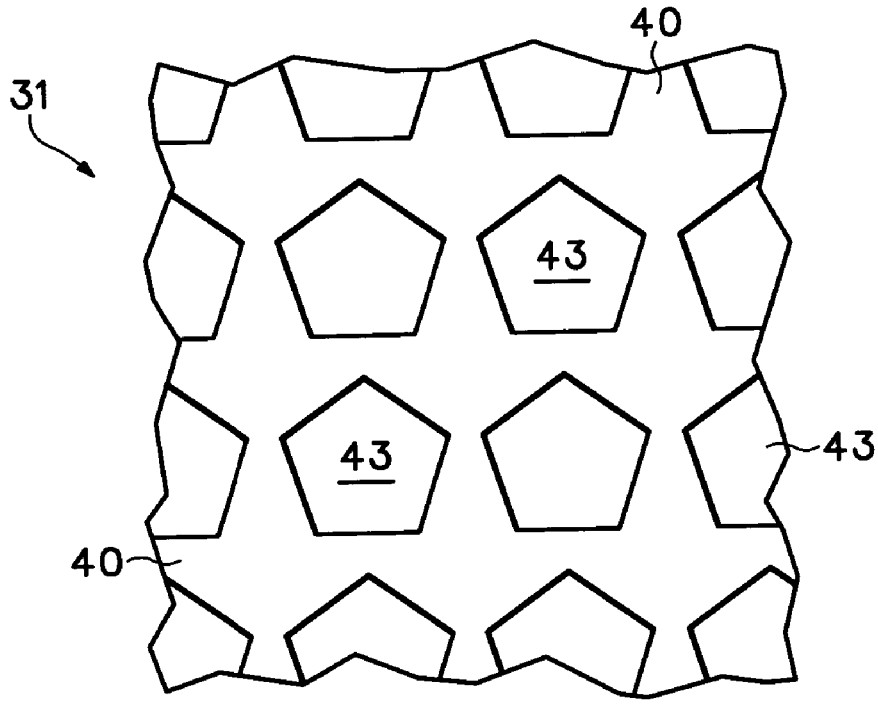
Figure 6G:
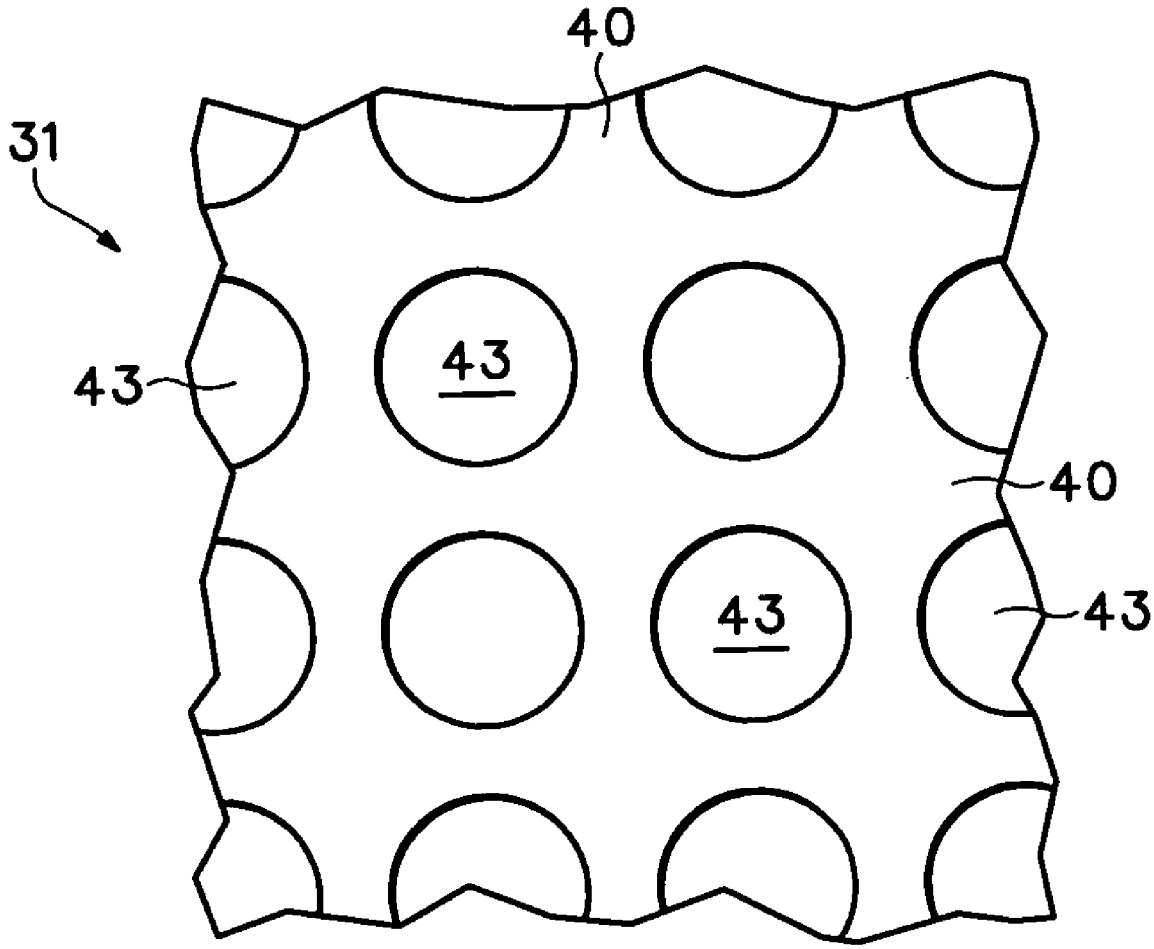

Bores 43 having other shapes may form a tessellation in either upper surface 41 or lower surface 42 of midsole element 40. Referring to FIG. 6C bores having a mixture of hexagonal, triangular, and square configurations are arranged to form a tessellation. Bores 43 having a chevron configuration or an irregular configuration may also be arranged to form a tessellation, as depicted in FIGS. 6D and 6E. Accordingly, bores 43 may form a tessellation when exhibiting non-regular geometrical or non-geometrical configurations. In other embodiments, bores 43 may exhibit pentagonal or round configurations, as depicted in FIGS. 6F and 6G. Accordingly, bores 43 may exhibit a variety of configurations within the scope of the present invention.

Figure 6H:
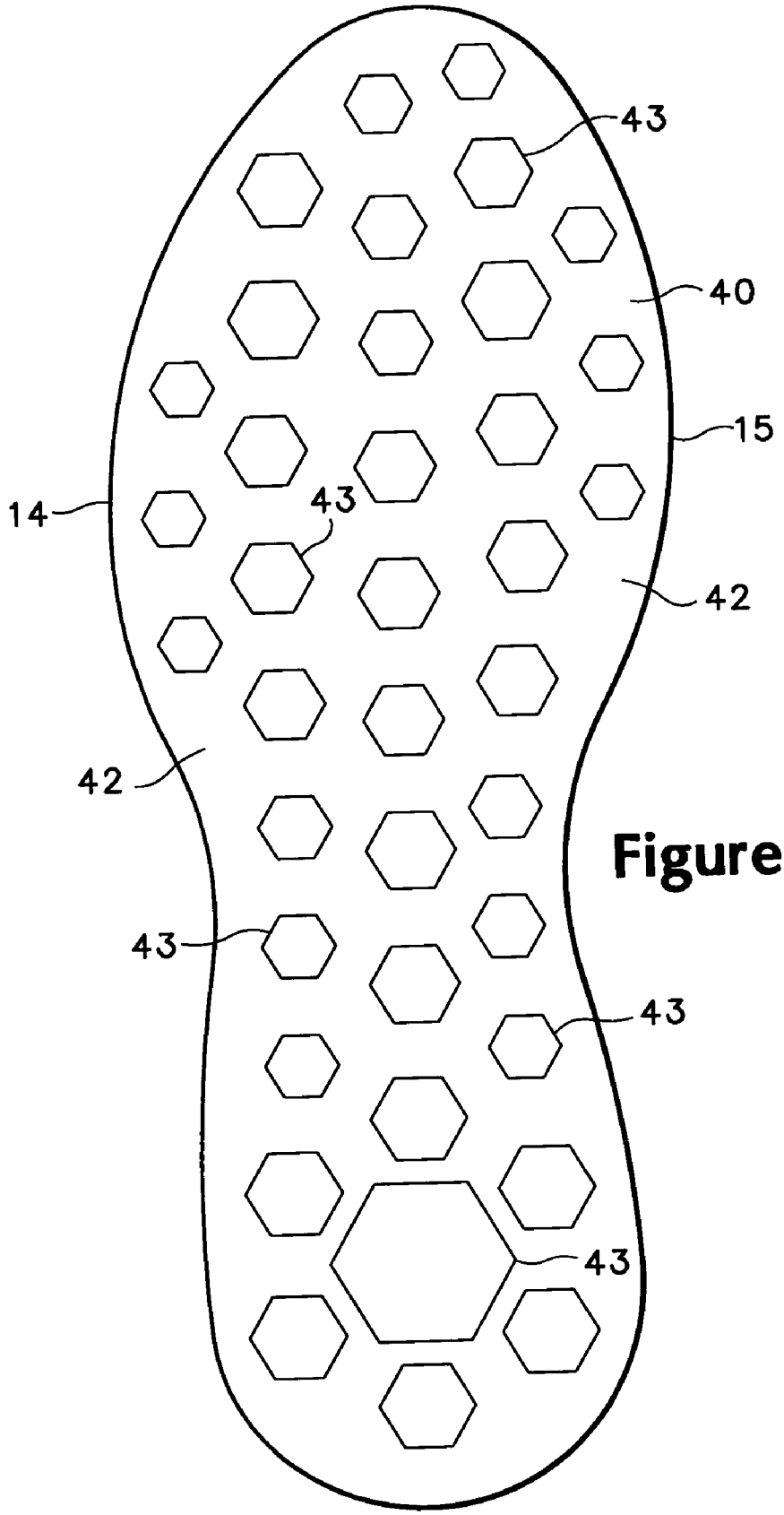
FIG. 6H is a bottom plan view of another alternate midsole configuration.

Each of bores 43 may exhibit similar dimensions or may also be configured to have a variety of dimensions. Referring to FIG. 6H, midsole element 40 defines a variety of bores 43 with hexagonal configurations. In contrast with the configuration of FIGS. 2-5, for example, bores 43 exhibit a greater variance in dimensions throughout the length of midsole element 40. In heel region 13, one of bores 43 is significantly larger than other bores 43, and the larger bore 43 is positioned to correspond in location with a calcaneus bone of a foot received by the void in upper 20. That is, the larger bore 43 will be generally positioned under the calcaneus bone of a foot. This configuration may be utilized, for example, to impart greater compliance to heel region 13 of midsole 31 and particularly the area under the calcaneus.

Based upon the above discussion, midsole element 40 may be formed from a polymer foam material that defines the various bores 43. In general, bores 43 are substantially vertical and extend through the polymer foam material and from first surface 41 to second surface 42. Bores 43 may exhibit a hexagonal shape, or may have a shape that is triangular, square, pentagonal, or round, for example. Depending upon the shape of bores 43, the various bores 43 may be arranged to form a tessellation. In some embodiments, bores 43 may be tapered, or the dimensions of bores 43 may vary.

Upper sheets 50*a*-50*c* and lower sheets 60*a*-60*c* extend respectively over selected portions of upper surface 41 and lower surface 42. More particularly, sheets 50*a*-50*c* and 60*a*-60*c* are secured to surfaces 41 and 42 to seal a fluid, such as air, within corresponding bores 43. Sheets 50*a*-50*c* and 60*a*-60*c* may be secured to midsole element 40 with an adhesive. In embodiments where sheets 50*a*-50*c* and 60*a*-60*c* are formed from a polymer material, sheets 50*a*-50*c* and 60*a*-60*c* may be bonded to midsole element 40. A variety of polymer materials may be utilized for sheets 50*a*-50*c* and 60*a*-60*c*, including nylon, nylon copolymer, rubber, polyurethane, polyester, polyester polyurethane, and polyether polyurethane, for example.

The locations of sheets 50*a*-50*c* and 60*a*-60*c* may be selected to impart various advantages to footwear 10. For example, the locations of sheets 50*a*-50*c* and 60*a*-60*c* may decrease the compressibility of specific areas of sole structure 30, or the locations of sheets 50*a*-50*c* and 60*a*-60*c* may impart stability or otherwise control foot motions, such as the degree of pronation. The specific configuration of sheets 50*a*-50*c* and 60*a*-60*c* depicted in FIGS. 2 and 3 is selected to correspond with the typical motion of the foot during running, which proceeds as follows: Initially, the heel strikes the ground, followed by the ball of the foot. As the heel leaves the ground, the foot rolls forward so that the toes make contact, and finally the entire foot leaves the ground to begin another cycle. During the time that the foot is in contact with the ground and rolling forward, it also rolls from the outside or lateral side to the inside or medial side, a process called pronation. While the foot is air-borne and preparing for another cycle, the opposite process, called supination, occurs. In order to impart a suitable degree of ground reaction force attenuation upon contact of the heel with the ground, sheets 50*a* and 60*a* are positioned in heel region 13. The degree of subsequent pronation may also be limited by decreasing the compressibility of medial side 15. Accordingly, sheets 50*b* and 60*b* are positioned in forefoot region 11 and primarily on medial side 15. Additional stability is also achieved through the placement of sheets 50*c* and 60*c* on lateral side 14 and in an area that extends between forefoot region 11 and midfoot region 12.

The positions of sheets 50*a*-50*c* and 60*a*-60*c* is one factor in footwear 10 that contributes to attenuating ground reaction forces, controlling foot motions, and enhancing stability. Another factor relates to the configuration of bores 43. The relative sizes, locations, and shapes of the various bores 43 may also be utilized to attenuate ground reaction forces, control foot motions, and enhance stability. For example, the larger bore 43 in heel region 13, as depicted in FIG. 6H, may be utilized in combination with sheets 50*a* and 60*a* to impart a suitable degree of ground reaction force attenuation upon contact of the heel with the ground. In addition, the configuration of bores 43 may also operate cooperatively with sheets 50*b*, 60*b*, 50*c*, and 60*c* to limit pronation and enhance stability. Accordingly, the advantages of sole structure 30 are gained through a combination of the configurations of bores 43 and the positions of sheets 50*a*-50*c* and 60*a*-60*c*.

Figure 7A:
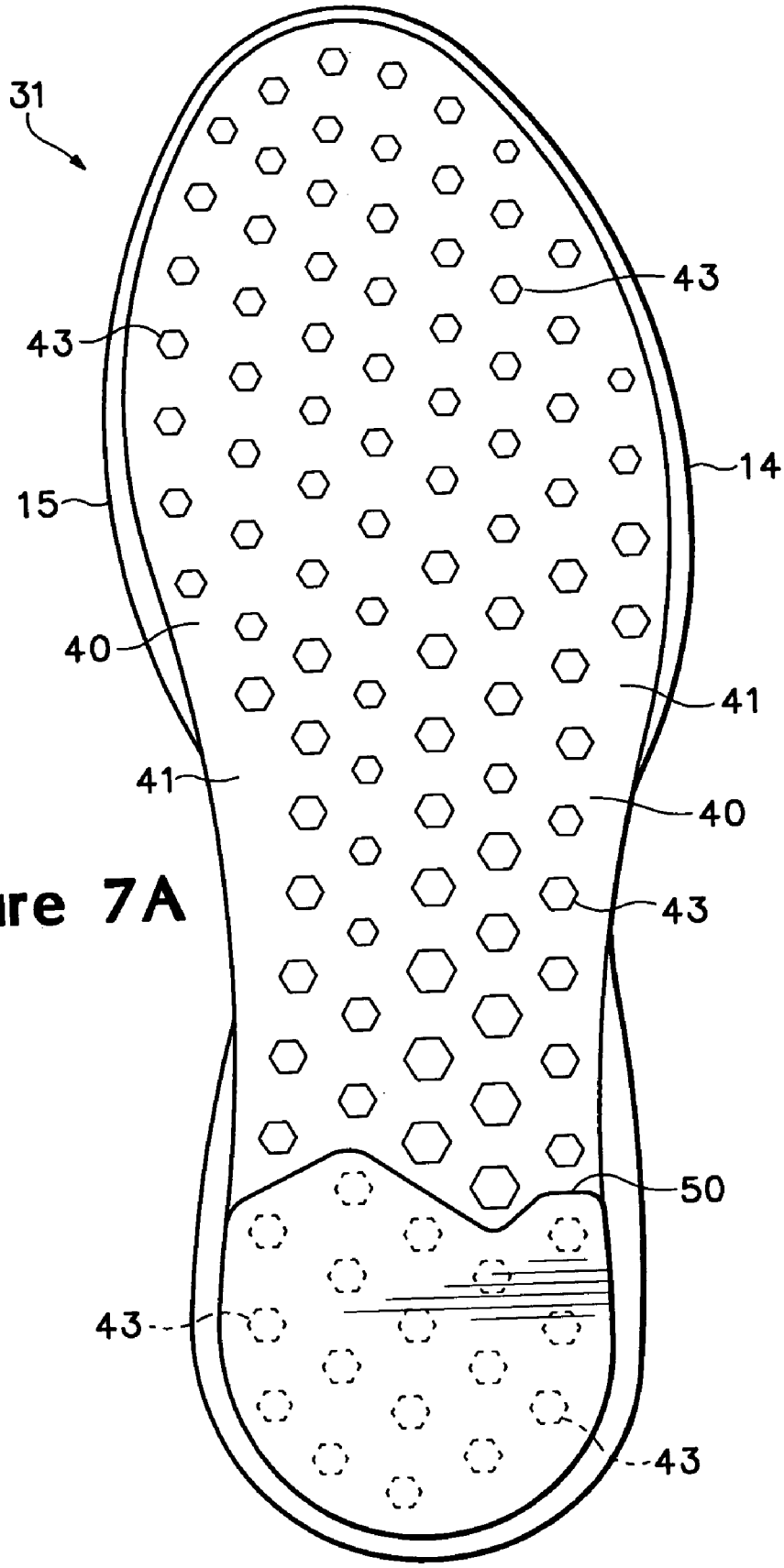
FIGS. 7A-7C are top plan views of midsoles having various alternate upper sheet configurations.
Figure 7B:
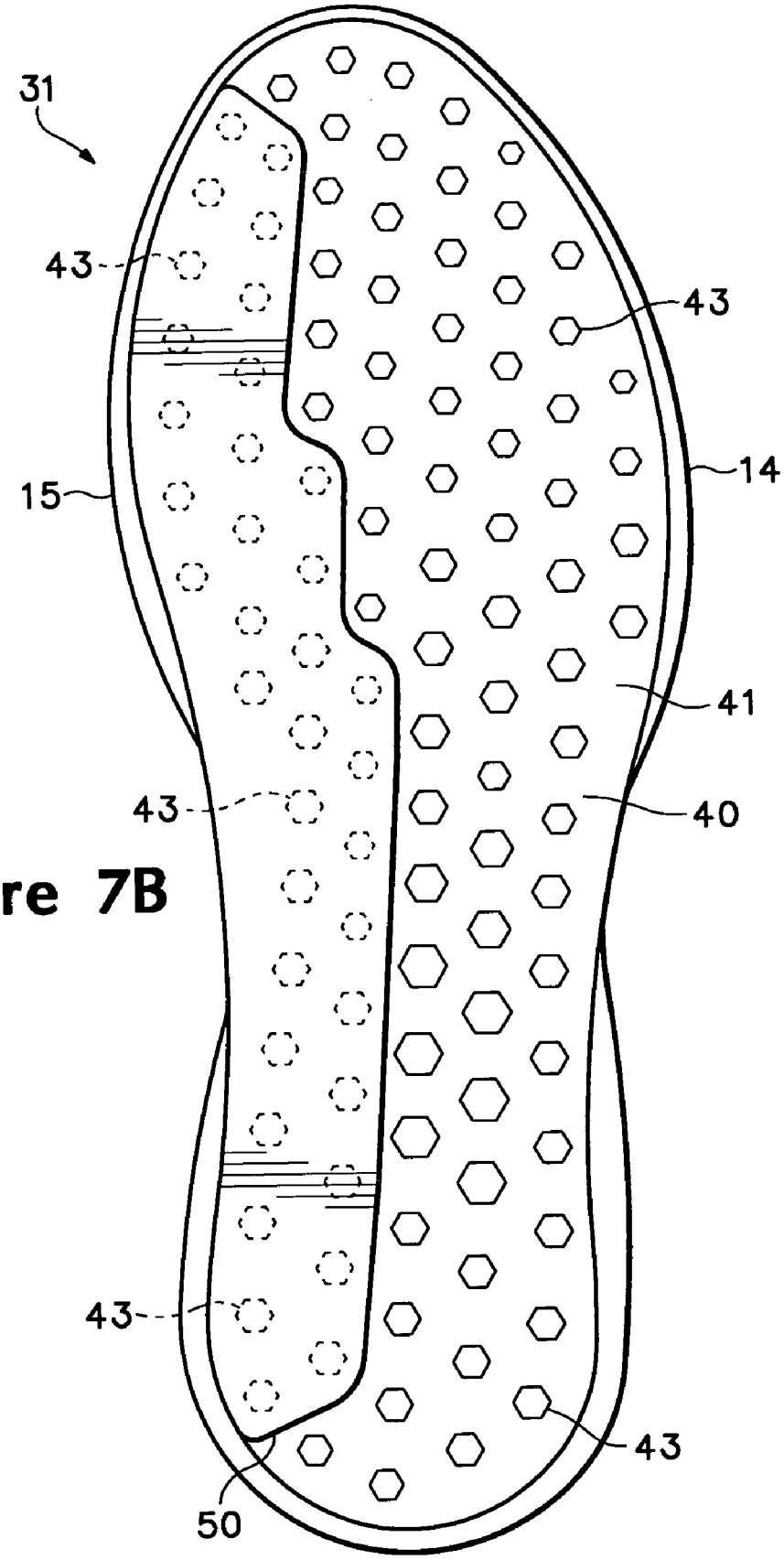
Figure 7C:
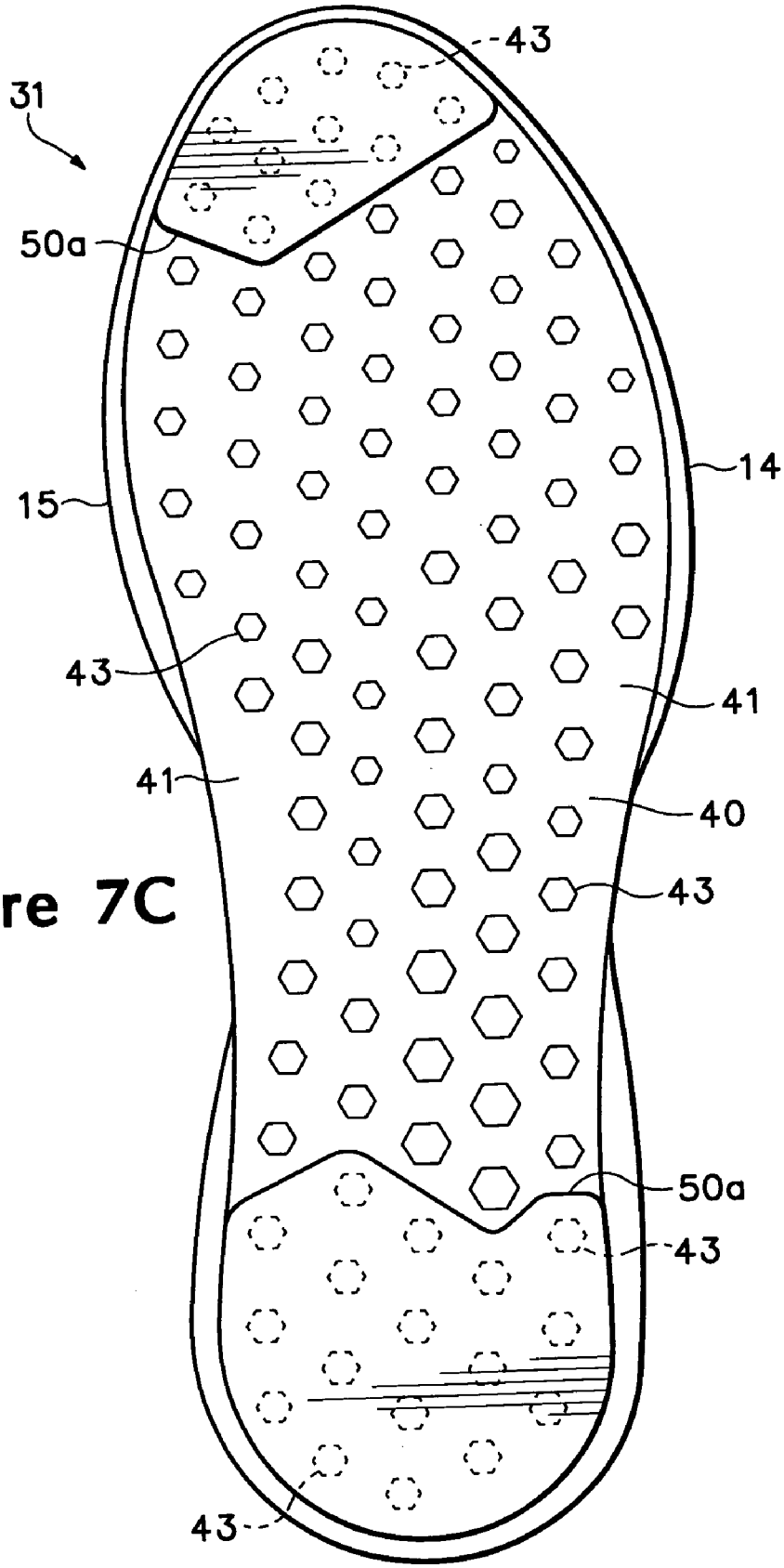
Figure 8A:
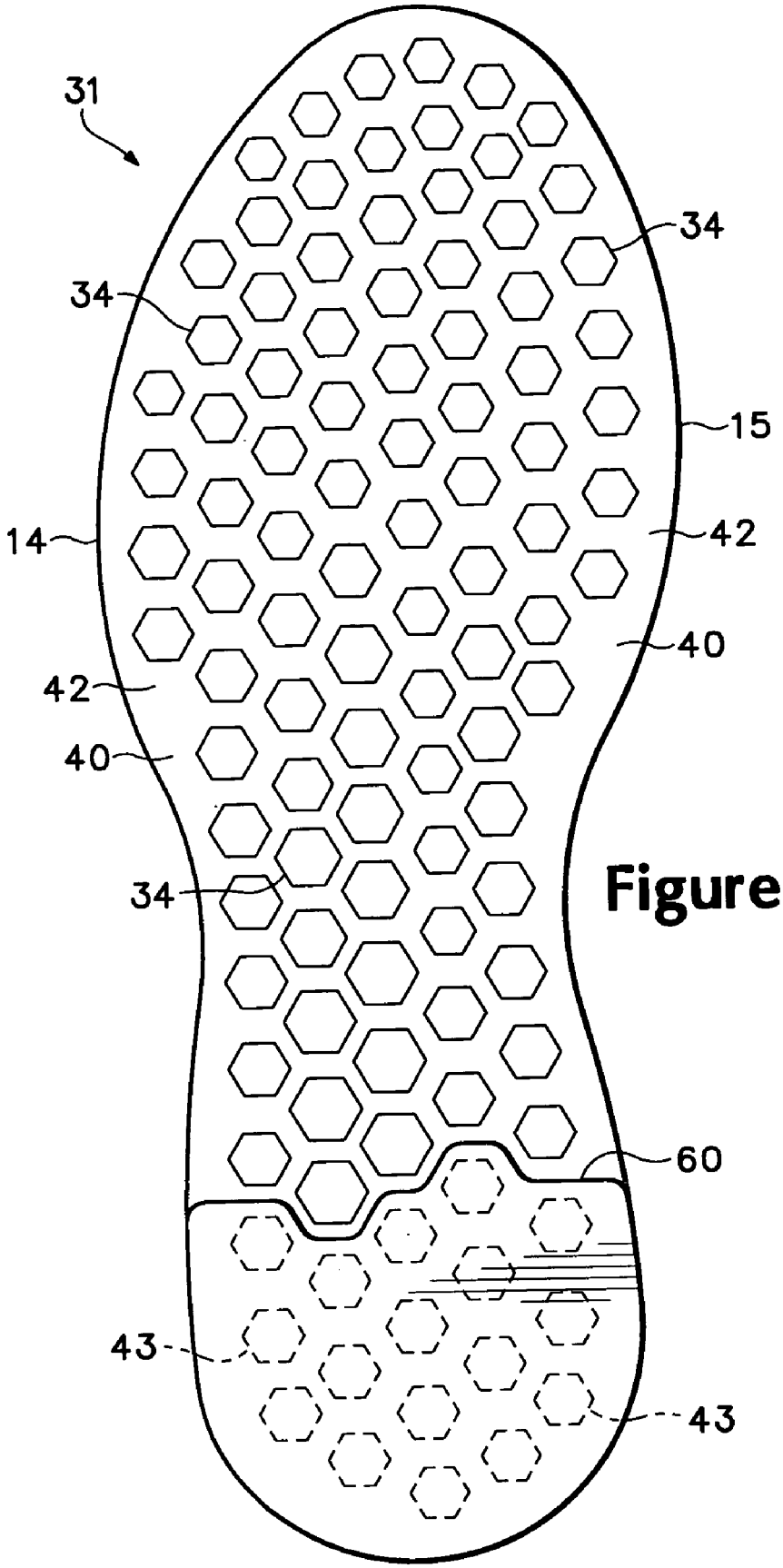
FIGS. 8A-8C are bottom plan views of midsoles having various corresponding lower sheet configurations.
Figure 8B:
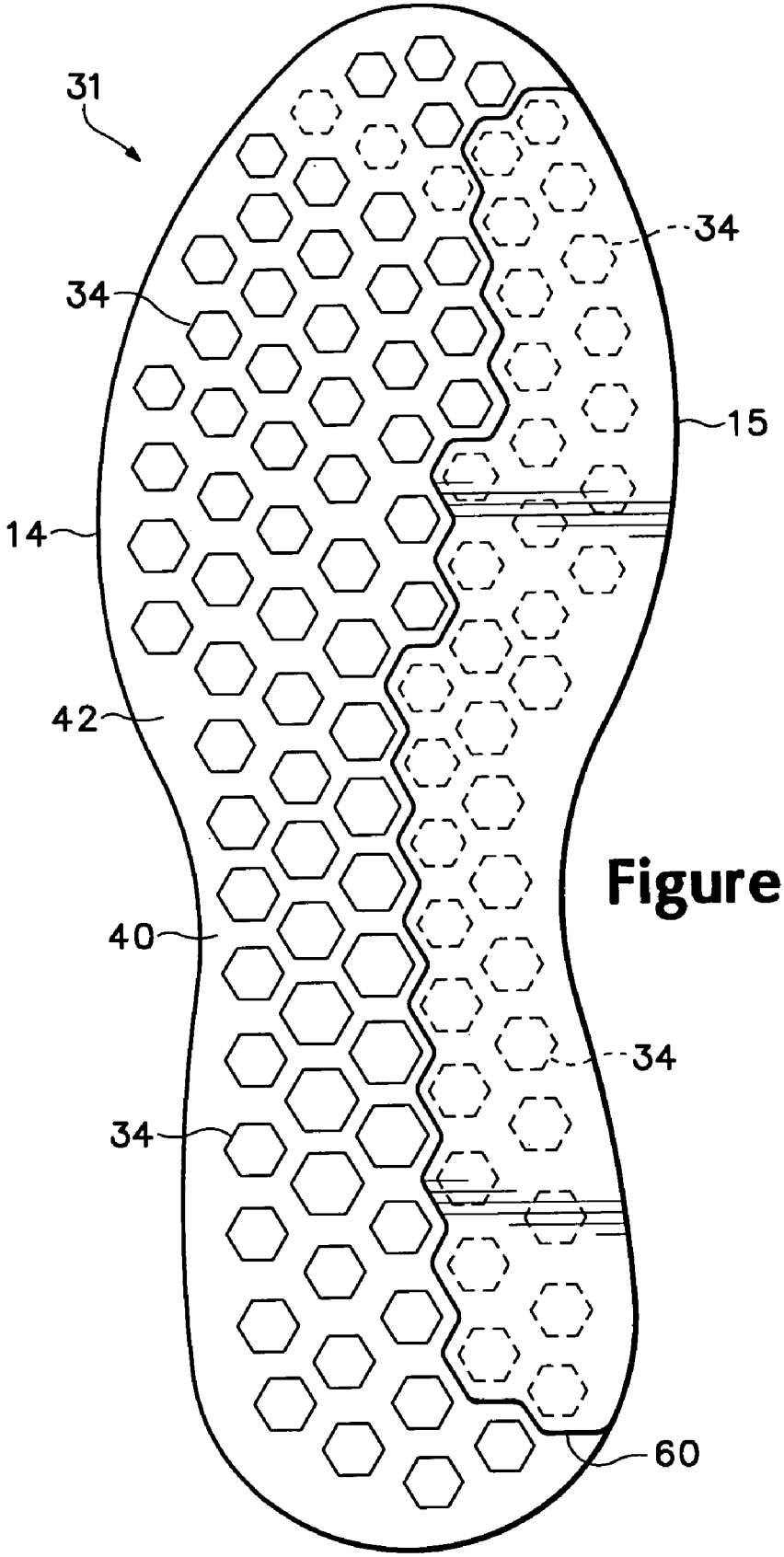
Figure 8C:
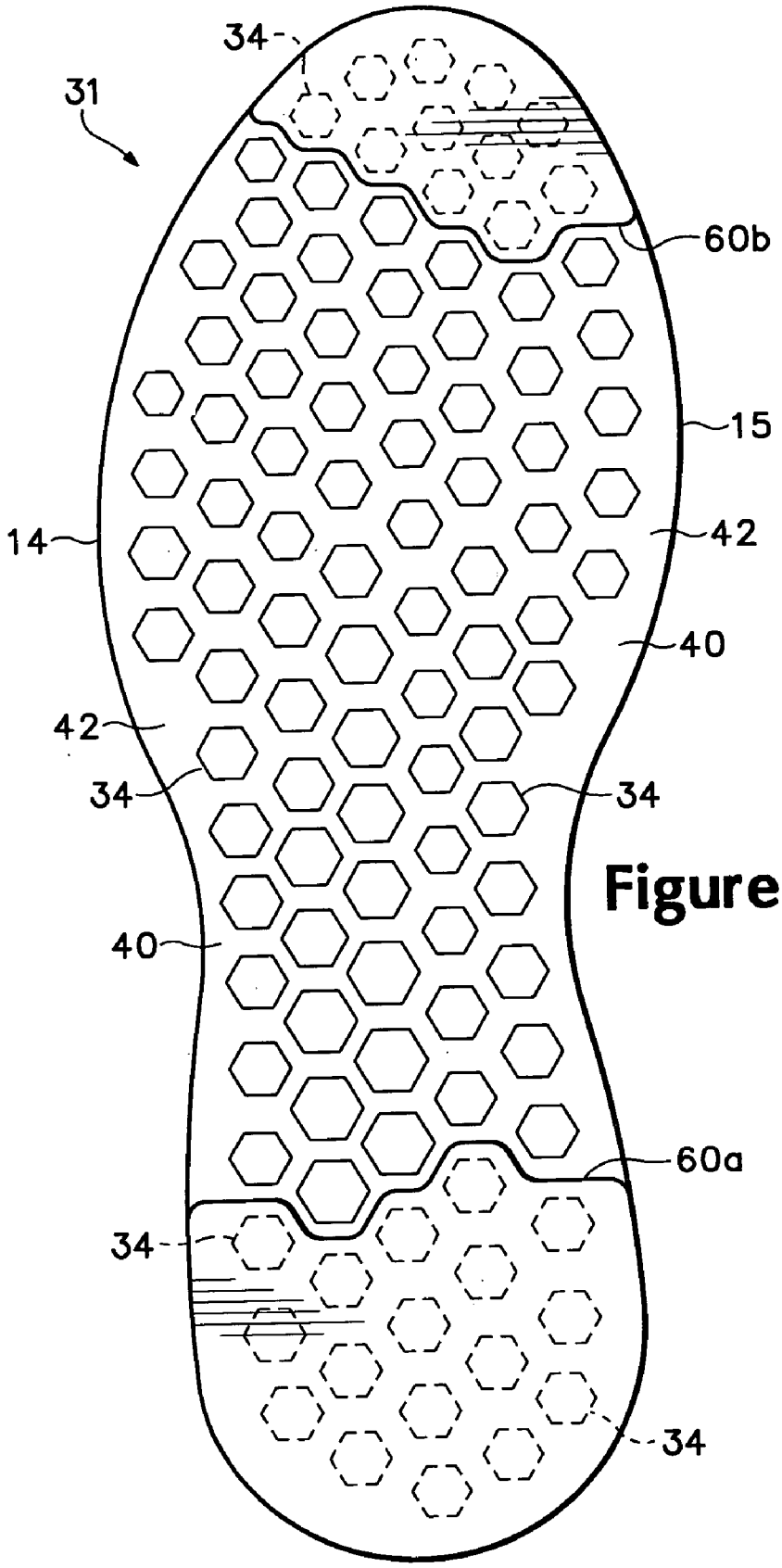

The specific locations of sheets 50*a*-50*c* and 60*a*-60*c* discussed above is one example of a configuration that is suitable for the present invention. Referring to FIGS. 7A and 8A, midsole 31 includes a single upper sheet 50 and a single lower sheet 60 that is limited to heel region 13. A single upper sheet 50 and a single lower sheet 60 may also extend along the longitudinal length of midsole element 40 and adjacent to medial side 15, as depicted in FIGS. 7B and 8B, in order to limit pronation. In another embodiment, as depicted in FIGS. 7C and 8C, a pair of upper sheets 50*a* and 50*b* and a pair of lower sheets 60*a* and 60*b* may be respectively positioned in heel region 13 and forefoot region 11, thereby leaving bores 43 in midfoot region 12 exposed. Accordingly, the number and locations of the various sheets 50*a*-50*c* and 60*a*-60*c* may vary significantly within the scope of the present invention.

Figure 9:
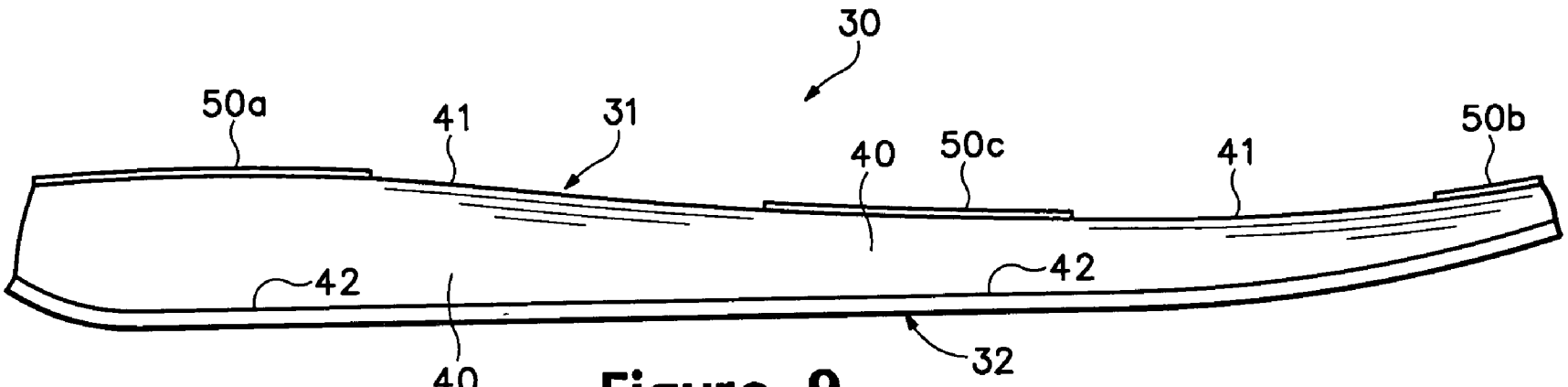
FIG. 9 is a lateral side elevational view of yet another alternate midsole configuration.

The presence of lower sheets 60*a*-60*c* may not be necessary in all embodiments of the invention, particularly when an outsole forms a lower surface of sole structure 30. Referring to FIG. 9, sole structure 30 is depicted as including midsole element 40, upper sheets 50*a* and 50*c*, and outsole 32. In contrast with prior embodiments, therefore, sole structure 30 does not include lower sheets 60*a*-60*c*. Instead, outsole 32 covers a substantial portion of lower surface 42 and effectively serves the purpose of lower sheets 60*a*-60*c*. In this configuration, the bores 43 associated with upper sheets 50*a*-50*c* remain sealed due to the presence of outsole 32, but other bores 43 remain exposed through upper surface 41.

Based upon the above discussion, upper sheets 50*a*-50*c* are secured to upper surface 41 and extend over at least a portion of bores 43. Similarly, lower sheets 60*a*-60*c* are secured to lower surface 42, are positioned to correspond in location with the upper sheets 50*a*-50*c*, and extend under the bores 43 that are covered by upper sheets 50*a*-50*c*. This configuration may seal a fluid within bores 43 that are associated with sheets 50*a*-50*c* and 60*a*-60*c*. Depending upon the specific configuration of footwear 10, the various sheets 50*a*-50*c* and 60*a*-60*c* may expose (i.e., not seal the fluid within) a portion of bores 43. In some embodiments, one or more of sheets 50*a*-50*c* and 60*a*-60*c* are positioned in forefoot region 11, midfoot region 12, heel region 13, or a combination of regions 11-13. One or more of sheets 50*a*-50*c* and 60*a*-60*c* may also be positioned adjacent to lateral side 14 or medial side 15. In addition, lower sheets 60*a*-60*c* may be replaced by outsole 32 in some embodiments.

Each of the figures disclose midsole 31 as extending through each of regions 11-13. In some embodiments, midsole 31 may be formed of two or more discrete sections. For example, midsole 31 may include a first section that is primarily located in forefoot region 11, and midsole 31 may include a second section that is primarily located in heel region 13. One or both of the first section and the second section may include bores 43 and one or more of sheets 50*a*-50*c* and 60*a*-60*c*. Accordingly, one or more discrete midsole sections may incorporate the various features discussed above with respect to midsole 31.

Footwear 10 may be generally manufactured by molding midsole element 40 from a polymer foam material to define the plurality of bores 43. Upper sheets 50*a*-50*c* and lower sheets 60*a*-60*c*, for example, may then be secured to midsole element 40 in any of the locations discussed above. The combination of midsole element 40, upper sheets 50*a*-50*c*, and lower sheets 60*a*-60*c* are then incorporated into footwear 10. As discussed above, the various bores 43 may be formed by projections that extend between upper and lower portions of the mold. Hexagonal or other shapes may be imparted to bores 43 by the protrusions. In addition, tapering or changes in the dimensions of bores 43 may be imparted by the protrusions. Accordingly, the molding process may be utilized to provide midsole element 40 with any of the configurations discussed above, including the configuration of a tessellation.

The present invention is disclosed above and in the accompanying drawings with reference to a variety of embodiments. The purpose served by the disclosure, however, is to provide an example of the various features and concepts related to the invention, not to limit the scope of the invention. One skilled in the relevant art will recognize that numerous variations and modifications may be made to the embodiments described above without departing from the scope of the present invention, as defined by the appended claims.

The invention claimed is:

1. An article of footwear having an upper and a sole structure secured to the upper, the sole structure comprising:

a midsole element formed from a polymer material and having a first surface and an opposite second surface, the midsole element extending substantially through a longitudinal length of the sole structure and from a lateral side to a medial side of the sole structure, the midsole element defining a plurality of bores extending through the polymer material and from the first surface to the second surface;

a first sheet secured to the first surface and extending over a first portion of the bores and exposing a second portion of the bores; and a second sheet secured to the second surface, the second sheet being positioned to correspond in location with the first sheet and extend under the first portion of the bores.

2. The article of footwear recited in claim 1, wherein the bores have a hexagonal shape.

3. The article of footwear recited in claim 1, wherein the bores form a tessellation.

4. The article of footwear recited in claim 1, wherein the bores are tapered.

5. The article of footwear recited in claim 1, wherein dimensions of the bores vary throughout the midsole element.

6. The article of footwear recited in claim 1, wherein the bores have a substantially vertical orientation.

7. The article of footwear recited in claim 1, wherein the first sheet and the second sheet are positioned in a heel region of the footwear.

8. The article of footwear recited in claim 1, wherein the first sheet and the second sheet are positioned in a forefoot region of the footwear.

9. The article of footwear recited in claim 1, wherein the first sheet and the second sheet are positioned adjacent the medial side.

10. The article of footwear recited in claim 1, wherein the first sheet forms three discrete portions that are respectively positioned in a heel region of the footwear, at least one of a forefoot region and a midfoot region of the footwear, and the forefoot region.

11. The article of footwear recited in claim 10, wherein the second sheet forms three discrete portions positioned to correspond in location with the three discrete portions of the first sheet.

12. The article of footwear recited in claim 10, wherein at least one of the three discrete portions is positioned adjacent the medial side, and another of the three discrete portions is positioned adjacent the lateral side.

13. The article of footwear recited in claim 1, wherein the first sheet and the second sheet are formed from a polymer material, and the first sheet and the second sheet are bonded to the midsole element.

14. The article of footwear recited in claim 1, wherein the first sheet and the second sheet seal a fluid within the bores.

15. An article of footwear having an upper and a sole structure secured to the upper, at least a portion of the sole structure consisting of:

a midsole element formed from a polymer material and having a first surface and an opposite second surface, the midsole element defining a plurality of bores extending from the first surface to the second surface, the bores forming a tessellation in at least a portion of the midsole element;

a first sheet secured to the first surface and extending over a first portion of the bores and exposing a second portion of the bores; and a second sheet secured to the second surface and extending under the first portion of the bores.

16. The article of footwear recited in claim 15, wherein the midsole element extends substantially through a longitudinal length of the sole structure and from a lateral side to a medial side of the sole structure.

17. The article of footwear recited in claim 15, wherein the second sheet is positioned to correspond in location with the first sheet.

18. The article of footwear recited in claim 15, wherein the bores are oriented to be substantially vertical.

19. The article of footwear recited in claim 15, wherein a shape of the bores is selected from a group consisting of triangular, square, and hexagonal.

20. The article of footwear recited in claim 15, wherein the bores are tapered.

21. The article of footwear recited in claim 15, wherein the first sheet forms three discrete portions that are respectively positioned in a heel region of the footwear, at least one of a forefoot region and a midfoot region of the footwear, and the forefoot region.

22. The article of footwear recited in claim 21, wherein the second sheet forms three discrete portions positioned to correspond in location with the three discrete portions of the first sheet.

23. The article of footwear recited in claim 15, wherein the first sheet and the second sheet seal a fluid within the bores.

* * * * *